US009904218B2

(12) United States Patent
Kimura et al.

(10) Patent No.: US 9,904,218 B2
(45) Date of Patent: Feb. 27, 2018

(54) HEATING DEVICE AND IMAGE FORMING APPARATUS

(71) Applicant: FUJI XEROX CO., LTD., Tokyo (JP)

(72) Inventors: Koichi Kimura, Ebina (JP); Toshinori Sasaki, Ebina (JP); Mizuki Sugino, Ebina (JP); Mitsutoshi Hongo, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/254,721

(22) Filed: Sep. 1, 2016

(65) Prior Publication Data

US 2017/0255141 A1 Sep. 7, 2017

(30) Foreign Application Priority Data

Mar. 4, 2016 (JP) ..... 2016-041778

(51) Int. Cl.
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2064; G03G 15/2078
See application file for complete search history.

(56) References Cited

U.S. PATENT DOCUMENTS

2010/0008683 A1* 1/2010 Yoshikawa ..... G03G 15/1695 399/45

FOREIGN PATENT DOCUMENTS

| | | | |
|---|---|---|---|
| EP | 0 436 955 | A2 | 7/1991 |
| JP | H03-208076 | A | 9/1991 |
| JP | H10-78716 | A | 3/1998 |
| JP | 2003-005574 | A | 1/2003 |
| JP | 2004-144846 | A | 5/2004 |
| JP | 2010-039043 | A | 2/2010 |
| JP | 2013-064794 | A | 4/2013 |

OTHER PUBLICATIONS

Nov. 28, 2016 Office Action issued in Japanese Patent Application No. 2016-041778.
Aug. 9, 2016 Office Action issued in Japanese Patent Application No. 2016-041778.

* cited by examiner

*Primary Examiner* — Hoang Ngo
(74) *Attorney, Agent, or Firm* — Oliff PLC

(57) ABSTRACT

A heating device includes a conveying unit, a heating unit, a temperature detecting unit and a controller. The conveying unit conveys a recording material. The heating unit includes a plurality of heat sources which are disposed so that locations thereof are different from each other in a conveying direction of the recording material, and heats the conveyed recording material. The temperature detecting unit is positioned on an upstream side in the conveying direction of the recording material with respect to the plurality of heat sources, and detects a temperature of the heating unit. The controller controls one of the plurality of heat sources based on a detecting result obtained by the temperature detecting unit. The one of the plurality of heat sources is positioned on the upstream side in the conveying direction of the recording material.

4 Claims, 3 Drawing Sheets

HEATING DEVICE AND IMAGE FORMING APPARATUS

CROSS-REFERENCE TO RELATED APPLICATIONS

This application is based on and claims priority under 35 USC 119 from Japanese Patent Application No. 2016-041778 filed Mar. 4, 2016.

BACKGROUND

Technical Field

The present invention relates to a heating device and an image forming apparatus.

SUMMARY

According to an aspect of the invention, a heating device includes a conveying unit, a heating unit, a temperature detecting unit and a controller. The conveying unit conveys a recording material. The heating unit includes a plurality of heat sources which are disposed so that locations thereof are different from each other in a conveying direction of the recording material, and heats the conveyed recording material. The temperature detecting unit is positioned on an upstream side in the conveying direction of the recording material with respect to the plurality of heat sources, and detects a temperature of the heating unit. The controller controls one of the plurality of heat sources based on a detecting result obtained by the temperature detecting unit. The one of the plurality of heat sources is positioned on the upstream side in the conveying direction of the recording material.

BRIEF DESCRIPTION OF THE DRAWINGS

Exemplary embodiments of the present invention will be described in detail based on the following figures, wherein.

DETAILED DESCRIPTION

Hereinafter, the exemplary embodiment of the present invention will be described in detail with reference to accompanying drawings.

Figure 1:
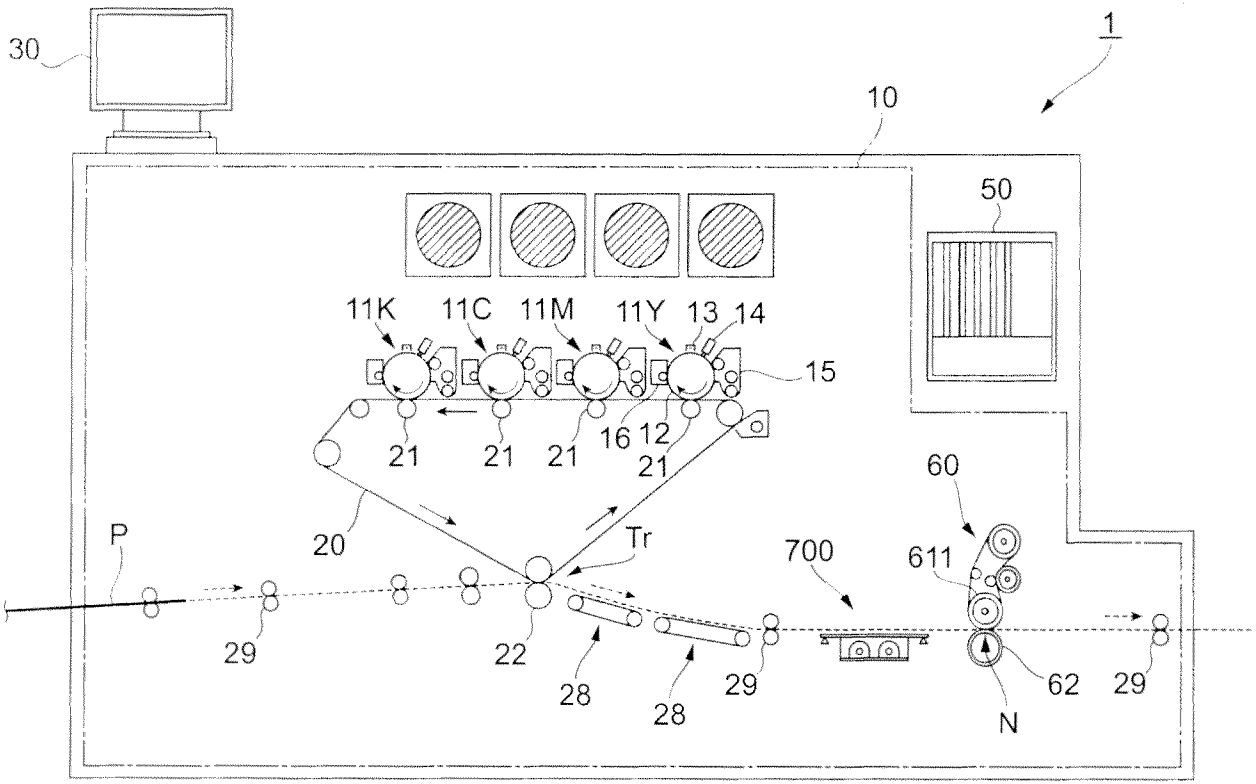
FIG. 1 is a diagram illustrating a configuration example of an image forming apparatus.

FIG. 1 is a diagram illustrating a configuration example of an image forming apparatus 1 according to the present exemplary embodiment.

The image forming apparatus 1 as shown in FIG. 1 is a so-called tandem-type color printer, and includes an imaging forming unit 10 for forming an image based on image data. In addition, the image forming apparatus 1 includes a main controller 50.

The main controller 50 as an example of a controller includes a central processing unit (CPU) controlled by a program and performs operation controlling of each device and each functional unit which are provided in the image forming apparatus 1, communicating with a personal computer or the like, or processing with respect to the image data.

Furthermore, a user interface unit 30 which receives an operation unit from a user or displays various information items to the user is provided in the image forming apparatus 1.

The imaging forming unit 10 as an example of an image forming unit is, for example, a functional unit for forming an image by an electrophotographic system and includes four image forming units of a yellow (Y) image forming unit 11Y, a magenta (M) image forming unit 11M a cyan (C) image forming unit 11C, and a black (K) image forming unit 11K.

In the following description, in a case where each of the image forming units is not specifically distinguished from each other, it is simply referred to as an "image forming unit 11".

Each image forming unit 11 of the image forming unit 11Y, the image forming unit 11M, the image forming unit 11C, and the image forming unit 11K forms a yellow toner image, a magenta toner image, a cyan toner image, and a black toner image, respectively.

In each image forming unit 11, a photoconductor drum 12 on which a toner image of each color formed after an electrostatic latent image is formed is provided. In addition, a charging unit 13 for charging a surface of the photoconductor drum 12, and an exposure tool 14 in which the photoconductor drum 12 which is charged by the charging unit 13 is exposed based on the image data are provided in the each image forming unit 11.

Furthermore, a developing unit 15 for developing the electrostatic latent image, which is formed on the photoconductor drum 12, with each color toner, and a cleaner 16 for cleaning the surface of the photoconductor drum 12 after transfer are provided in each image forming unit 11.

In addition, an intermediate transfer belt 20 on which a toner image of each color which is formed on the photoconductor drum 12 of each image forming unit 11 is transferred, and a primary transfer roll 21 for transferring (primary transferring) a toner image of each color formed in each image forming unit 11 to the intermediate transfer belt 20 are provided in the imaging forming unit 10.

In addition, a secondary transfer roll 22 for batch transferring (secondary transferring) a toner image of each color which is transferred on the intermediate transfer belt 20 in a superposed manner with respect to a recording material P is provided in the imaging forming unit 10.

Furthermore, a fixing device 60 for fixing a toner image of each color secondarily transferred onto the recording material P is provided in the imaging forming unit 10.

In the present exemplary embodiment, a region, where the secondary transfer roll 22 is disposed and a toner image of each color on the intermediate transfer belt 20 is secondarily transferred onto the recording material P, is referred to as a secondary transfer region Tr below.

Here, examples of the recording material P include paper, a resin sheet, a region film, and the like.

In the present exemplary embodiment, a case where an image is formed with respect to the continuous recording material P (belt-like recording material P) which extends along the conveying direction of the recording material P will be described as an example without the recording material P cut one by one.

The operation of the image forming apparatus 1 will be described.

To form the image, each of the image forming units 11 forms a toner image of each color of black, cyan, magenta, and yellow by an electrophotographic process.

A toner image of each color formed by each of the image forming units 11 is primarily transferred on the intermediate transfer belt 20 by the primary transfer roll 21, sequentially, and the toner image in which each toner is superposed is formed on the intermediate transfer belt 20.

The toner image on the intermediate transfer belt 20 is conveyed to the secondary transfer region Tr in which the secondary transfer roll 22 is disposed in accordance with the movement of the intermediate transfer belt 20.

In a recording material conveying system, the recording material P is fed out from a feeding roll (not shown) in which the recording material P is wound and the recording material P is conveyed along a predetermined convey path and reaches to the secondary transfer region Tr. In the secondary transfer region Tr, the toner image on the intermediate transfer belt 20 is secondarily transferred in a batch to the recording material P by a transfer electric field formed by the secondary transfer roll 22.

Thereafter, the recording material P onto which the toner image is transferred is conveyed toward a heating device 700 and a fixing device 60 by a convey belt 28, a convey roll 29, or the like as an example of a conveying unit. The recording material P is heated by the heating device 700 on the way to the fixing device 60.

In the fixing device 60, the recording material P is fed with respect to a nip portion N of the fixing device 60. Accordingly, pressing and heating of the recording material P is performed and fixing of the toner image to the recording material P is performed. Thereafter, the recording material P is wound by a winding device (not shown).

Here, for heating the recording material P by only the fixing device 60, it is required to increase the output of the fixing device 60 and the size of the fixing device 60 is easily increased. By providing the heating device 700, the increase in the size of the fixing device 60 is suppressed.

In addition, in the present exemplary embodiment, a fixing roll 611 provided in the fixing device 60 is press-fitted to a pressure roll 62 to form the nip portion N.

However, any of the fixing roll 611 and the pressure roll 62 of the present exemplary embodiment has a roll shape, and in this case, a contacted area between the fixing roll 611 and the pressure roll 62 is decreased. In this case, a heat capacity to be applied to the recording material P is easily decreased.

When the heating device 700 is provided, as compared to a case where heat is supplied to the recording material P by only the fixing device 60, the heat capacity to be supplied to the recording material P is increased.

Figure 2:
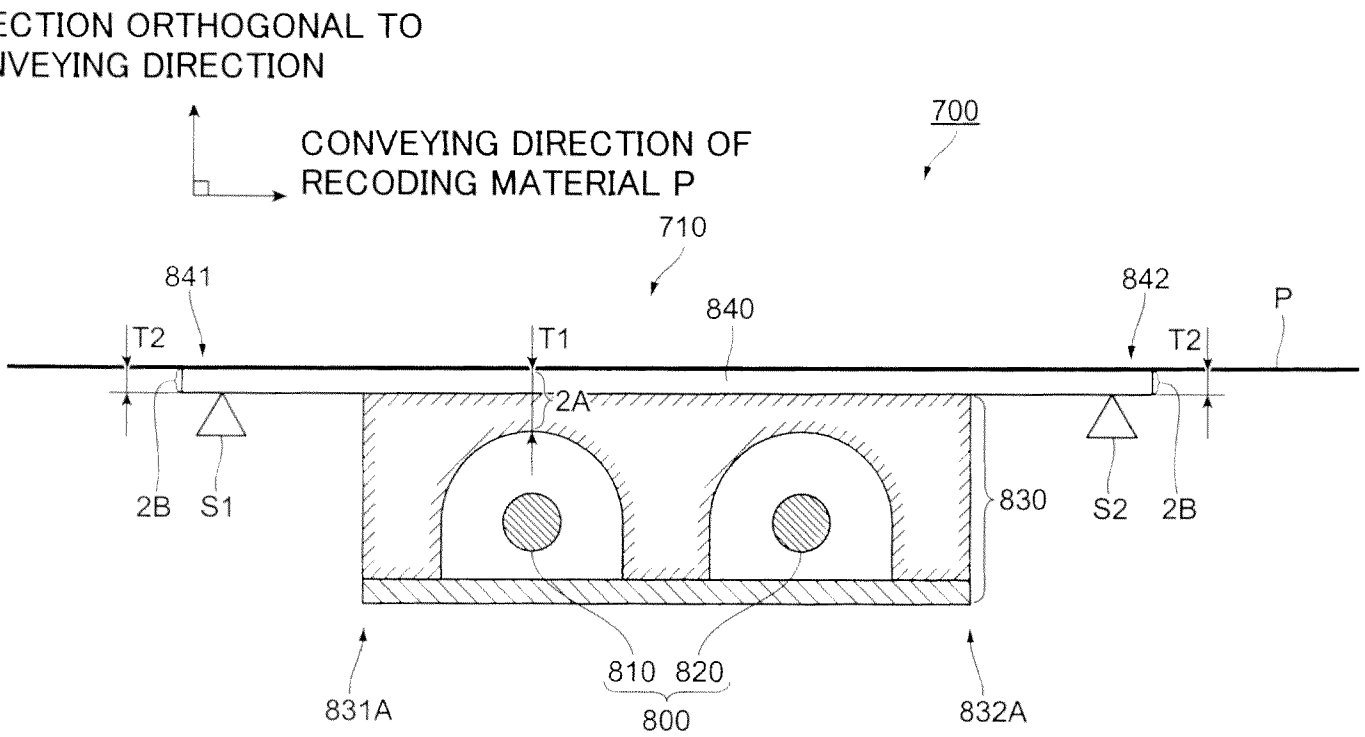
FIG. 2 is a diagram illustrating a heating device.

FIG. 2 is a diagram illustrating the heating device 700.

A heating unit 710 as an example of the heating unit for heating the recording material P is provided in the heating device 700. A heat source 800 is provided in the heating unit 710. The heat source 800 includes a first heat source 810 and a second heat source 820.

The first heat source 810 and the second heat source 820 are disposed so that locations thereof are different from each other in a conveying direction of the recording material P. In the present exemplary embodiment, in the conveying direction of the recording material P, the first heat source 810 is positioned at the upstreamside and the second heat source 820 is positioned at the downstream side. The first heat source 810 and the second heat source 820 are, for example, a halogen heater.

Furthermore, an accommodating housing 830, which is formed in a rectangular parallelepiped shape, is formed by a metal material, and accommodates the first heat source 810 and the second heat source 820, is formed in the heating unit 710.

Furthermore, a contact member 840 which is in contact with the recording material P to be conveyed on the conveying path is formed on a conveying path side of the recording material P in relation to the accommodating housing 830.

In the present exemplary embodiment, the contact member 840 is provided between the recording material P to be conveyed and the heat source 800. The contact member 840 is formed by a plate material and is provided so as to extend along the conveying direction of the recording material P. Furthermore, the contact member 840 is disposed below the recording material P to be conveyed and is in contact with the recording material P from below.

In addition, in the present exemplary embodiment, in a case where a length of the contact member 840 in the conveying direction of the recording material P is compared to a length of the accommodating housing 830 in the conveying direction of the recording material P, the length of the contact member 840 becomes larger.

Furthermore, the contact member 840 includes an upstream side end portion 841 on the upstream side in the convening direction of the recording material P and a downstream side end portion 842 on the downstream side in the conveying direction of the recording material P.

Furthermore, in the present exemplary embodiment, the upstream side end portion 841 of the contact member 840 is positioned on the upstream side in the conveying direction of the recording material P in relation to an upstream end 831A (end portion positioned furthest toward the upstream side in the conveying direction of the recording material P) of the accommodating housing 830.

In addition, the downstream side end portion 842 of the contact member 840 is positioned on the downstream side in the conveying direction of the recording material P in relation to an downstream end 832A (end portion located furthest toward the downstream side in the conveying direction of the recording material P) of the accommodating housing 830.

Furthermore, in the present exemplary embodiment, an upstream side temperature, sensor S1 and a downstream side temperature sensor S2 for detecting the temperature of the heating unit 710 are provided.

The upstreamside temperature sensor S1 as an example of the temperature detecting unit is positioned on the upstream side of the recording material P in the conveying direction in relation to the first heat source 810 and the second heat source 820 provided in the heating unit 710.

The upstreamside temperature sensor S1 detects the temperature of the upstream side end portion 841 (a portion positioned at the upstream side in relation to the accommodating housing 830) of the contact member 840.

The downstream side temperature sensor S2 as an example of the downstream side detecting unit is positioned on the downstream side of the recording material P in the conveying direction in relation to the first heat source 810 and the second heat source 820 provided in the heating unit 710. The downstream side temperature sensor S2 detects the temperature of the downstream side end portion 842 (a portion positioned at the downstream side in relation to the accommodating housing 830) of the contact member 840.

A heating process of the recording material P by the heating device 700 will be described.

In the age forming apparatus 1 according to the present exemplary embodiment, the main controller 50 as an example of the controller outputs a control signal at a predetermined timing such as at a time of power input or at a time of return from a power-saving mode. Therefore, the first heat source 810 and the second heat source 820 are in the turned-off state until then are turned on. Accordingly, the temperature of the entire heating unit 710 is increased.

When the temperature detected by the upstream side temperature sensor S1 and the temperature detected by the downstream side temperature sensor S2 reach the predetermined temperature (when an upper limit value to be described is reached), the control signal is output from the main controller 50 and the first heat source 810 and the second heat source 820 are turned off once.

In the present exemplary embodiment, the signals from the upstream side temperature sensor S1 and the downstream side temperature sensor S2 are output from the main controller 50.

The main controller 50 is configured to control the first heat source 810 and the second heat source 820 based on the detecting result by the upstream side temperature sensor S1 and the downstream side temperature sensor S2.

Thereafter, in the present exemplary embodiment, conveying of the recording material P is started and forming of the image onto the recording material P by the imaging forming unit 10 is started. In the recording material P, a portion in which an image is not formed by the imaging forming unit 10 is toward the fixing device 60 (refer to FIG. 1) via the heating device 700 and in the fixing device 60, fixing the image to the recording material P is performed. A portion in which the fixing of the image is terminated in the recording material P is discharged to the outside the image forming apparatus 1.

Here, when the image forming onto the recording material P is sequentially performed, the heat of the heating unit 710 (refer to FIG. 2) is lost by the recording material P, and the temperature of the heating unit 710 is gradually lowered.

Specifically, in the present exemplary embodiment, since the recording material P comes into contact with the portion on the upstream side of the recording material P in the conveying direction in the heating unit 710, at first, the temperature is lowered from the portion on the upstream side of the heating unit 710. More specifically, the temperature is lowered from the portion of the upstream side end portion 841 of the contact member 840 (refer to FIG. 2). In this case, the temperature of the heating unit 710 is lower than the originally planned temperature, and the heat capacity to be supplied to the recording material P is decreased.

In the present exemplary embodiment, in a case where the temperature of the heating unit 710 is lowered, the first heat source 810 is turned on to increase the temperature of the heating unit 710.

Specifically, in the present exemplary embodiment, as described above, since the temperature is gradually lowered from a portion positioned on the upstream side in the heating unit 710, firstly, the first heat source 810 is turned on to increase the temperature of the portion on the upstream side of the heating unit 710.

More specifically, in the present exemplary embodiment, the temperature of the portion on the upstream side of the heating unit 710 is detected by the upstream side temperature sensor S1, and in a case where the temperature of the portion on the upstream side of the heating unit 710 is lower than the predetermined threshold value, the control signal is output from the main controller 50 and the first heat source 810 is turned on. Therefore, the temperature of the portion on the upstream side of the heating unit 710 increases.

In the present exemplary embodiment, in a case where even when the temperature of the portion on the upstream side of the heating unit 710 is lowered, the temperature of a portion on the downstream side is not lowered (in a case where the temperature detected by the downstream side temperature sensor S2 does not fall below the predetermined threshold value), the second heat source 820 is not turned on.

In the portion on the downstream side of the heating unit 710, the temperature is not yet lowered, and when the second heat source 820 is turned on, the portion on the downstream side is heated more than necessary.

On the other hand, in a case where the temperature of the portion on the downstream side of the heating unit 710 is lowered, the second heat source 820 is turned on. More specifically, in the present exemplary embodiment, the temperature of the portion on the downstream side of the heating unit 710 is detected by the downstream side temperature sensor S2, and in a case where the temperature of the portion on the downstream side of the heating unit 710 is lower than the predetermined threshold value, the control signal is output from the main controller 50, and the second heat source 820 is turned on.

Accordingly, the decrease in the temperature of the portion on the downstream side of the heating unit 710 is suppressed, and the predetermined heat capacity is supplied with respect to the recording material P.

In the present exemplary embodiment an upper limit value relating to the temperature is set, and in a case where the temperature detected by each of the upstream side temperature sensor S1 and the downstream side temperature sensor S2 exceeds the predetermined upper limit value, the main controller 50 controls the first heat source 810 and the second heat source 820 to be turned off.

Specifically, in a case where the temperature detected by the upstream side temperature sensor S1 exceeds the predetermined temperature (upper limit value), the main controller 50 controls the first heat source 810 to be turned off, and in a case where the temperature detected by the downstream side temperature sensor S2 exceeds the predetermined temperature, the main controller 50 controls the second heat source 820 to be turned off.

Here, in the present exemplary embodiment, a thickness of a portion in which a temperature is detected by the upstream side temperature sensor S1 and the downstream side temperature sensor S2 in the heating unit 710 is smaller than a thickness of a portion positioned between the heat source 800 and the recording material P to be conveyed (a portion positioned between the heat source 800 and the recording material convey path), in the heating unit 710.

Specifically, a thickness T2 of a portion shown by the reference numeral 2B in FIG. 2 is smaller than a thickness T1 of a portion shown by the reference numeral 2A in FIG. 2. Additionally remarking, in a case where thicknesses in a direction perpendicular to the conveying direction of the recording material P with each other, the thickness T2 of the portion shown by the reference numeral 2B is smaller than the thickness T1 of the portion shown by the reference numeral 2A.

In this case, as compared with a case where the thicknesses of the portions where the temperatures are detected by the upstream side temperature sensor S1 and the downstream side temperature sensor S2 are large, the response is improved upon detecting of the temperature of the heating unit 710. Furthermore, in this case, an accumulating section of the heat is provided between the heat source 800 and the recording material P to be conveyed (between the heat source 800 and the recording material convey path) and the heat capacity of the heating unit 710 is further increased.

In the present exemplary embodiment, a case where two heat sources the first heat source 810 and the second heat source 820 are used is described as an example.

However, the number of the heat sources is not limited to two, and may be three or more.

Here, for example, if the number of the heat sources is three, in a case where the temperature detected by the upstream side temperature sensor S1 is lower than the predetermined threshold value, for example, one heat source positioned furthest toward the upstream side among three heat sources is turned on, and in a case where the temperature detected by the downstream side temperature sensor S2 is lower than the predetermined temperature, the other two heat sources positioned on the downstream side are turned on.

Alternatively, for example, in a case where the temperature detected by the upstream side temperature sensor S1 is lower than the predetermined temperature, two heat sources positioned on the upstream side among three heat sources are turned on, and in a case where the temperature detected by the downstream side temperature sensor S2 is lower than the predetermined temperature, the other one heat source positioned furthest toward the downstream side is turned on.

In addition, in the above description, a case where the first heat source 810 and the second heat source 820 are turned on or turned off is described as an example, but it is not limited to control of the turning on or turning off.

The adjusting of the output may be performed.

Specifically, in a case where the temperatures detected by the upstream side temperature sensor S1 and the downstream side temperature sensor S2 exceed the predetermined temperature (upper limit value), the outputs of the first heat source 810 and the second heat source 820 decrease. In addition, in a case where the temperatures detected by the upstream side temperature sensor S1 and the downstream side temperature sensor S2 are lower than the predetermined temperature, the outputs of the first heat source 810 and the second heat source 820 increase.

In addition, in the above description, a case where an image is formed onto the continuous recording material P which extends along the conveying direction of the recording material P is described as an example.

However, even in a case where an image is formed onto the recording material P which one by one, the above-described processes are performed.

Figure 3:
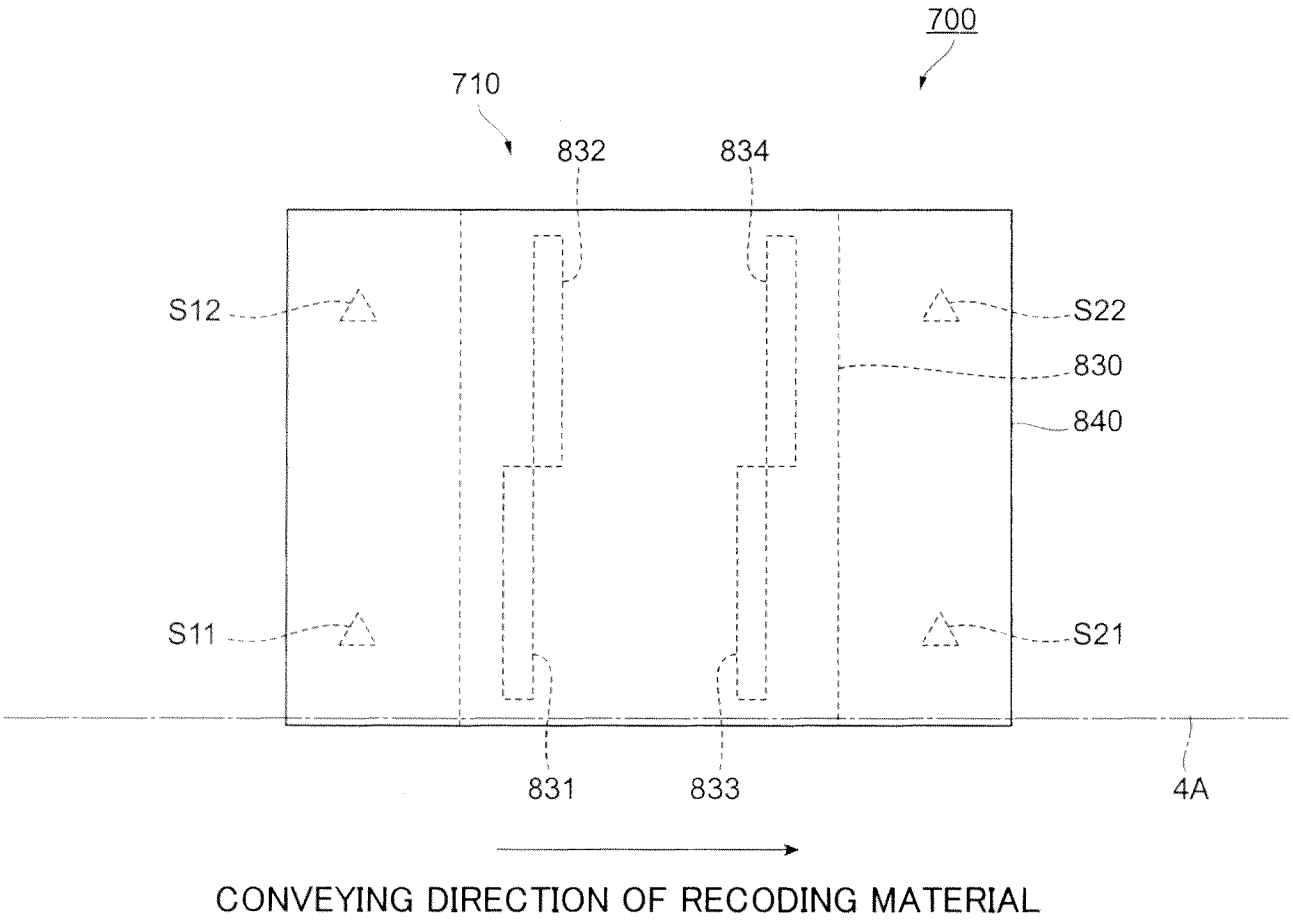
FIG. 3 is a diagram illustrating another configuration of the heating device and is a diagram illustrating a state of the heating device when viewed from above.

FIG. 3 is a diagram illustrating another configuration of the heating device 700 and is a diagram illustrating a state of the heating device 700 when viewed from above.

In the heating device 700 shown in FIG. 3, four heat sources of a first heat source 831 to a fourth heat source 834 are provided. Furthermore, in the image forming apparatus 1 including the heating device 700, two types of recording materials P having a difference size are conveyed.

Furthermore, in the heating device 700, a total of four temperature sensors of a first upstream side temperature sensor S11, a second upstream side temperature sensor S12, a first downstream side temperature sensor S21, and a second downstream side temperature sensor S22 are provided.

In the heating device 700 as shown in FIG. 3, the recording material P is conveyed in a so-called side standard, and a side of the recording material P passes above a predetermined conveying standard 4A, regardless of the size of the recording material P.

The first heat source 831 and the third heat source 833 are disposed on the conveying standard 4A side and the second heat source 832 and the fourth heat source 834 are disposed on a side facing the conveying standard 4A.

In addition, the first upstream side temperature sensor S11 and the first downstream side temperature sensor S21 are disposed on the conveying standard 4A side and the second upstream side temperature sensor S12 and the second downstream side temperature sensor S22 are disposed on a side facing the conveying standard 4A side.

In the configuration example, a used heat source is switched depending on the size of the recording material P to be conveyed.

When the size of the recording material P is large at a time of power input, four heat sources of the first heat source 831 to the fourth heat source 834 are turned on.

When the temperatures detected by the first upstreamside temperature sensor S11, the second upstreamside temperature sensor S12, the first downstream side temperature sensor S21, and the second downstream side temperature sensor S22 reach the predetermined temperature, the first heat source 831 to the fourth heat source 834 are turned off.

In a case where the temperatures detected by the first upstream side temperature sensor S11 and the second upstream side temperature sensor S12 are lower than the predetermined temperature in accordance with the conveying of the recording material P, the first heat source 831 and the second heat source 832 are turned on, and the temperatures detected by the first downstream side temperature sensor S21 and the second downstream side temperature sensor S22 are lower than the predetermined temperature, the third heat source 833 and the fourth heat source 834 are turned on.

On the other hand, when the size of the recording material P is small and at a time of the power input, two heat sources of the first heat source 831 and the third heat source 833 are turned on, and when the temperatures detected by the first upstream side temperature sensor S11 and the first downstream side temperature sensor S21 reach the predetermined temperature, the first heat source 831 and the third heat source 833 are turned off.

In a case where the temperature detected by the first upstream side temperature sensor S11 is lower than the predetermined temperature in accordance with the conveying of the recording material P, the first heat source 831 is turned on, and in a case where the temperature detected by the first downstream side temperature sensor S21 is lower than the predetermined temperature, the third heat source 833 is turned on.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device comprising:

a conveying unit that conveys a recording material;

a heating unit that includes a plurality of heat sources which are disposed so that locations thereof are different from each other in a conveying direction of the recording material, and that heats the conveyed recording material;

a temperature detecting unit that is positioned on an upstream side in the conveying direction of the recording material with respect to the plurality of heat sources, and that detects a temperature of the heating unit; and a controller that controls one of the plurality of heat sources based on a detecting result obtained by the temperature detecting unit, the one of the plurality of heat sources being positioned on the upstream side in the conveying direction of the recording material, wherein a thickness of a portion of the heating unit which temperature is to be detected by the temperature detecting unit is smaller than a thickness of a portion of the heating unit positioned between the conveyed recording material and the plurality of heat sources.

2. The heating device according to claim 1, further comprising:

a downstream side detecting unit that is positioned on a downstream side in the conveying direction of the recording material with respect to the plurality of heat sources, and that detects the temperature of the heating unit, wherein the controller controls another one of the plurality of heat sources based on a detecting result obtained by the downstream side detecting unit, the another one of the plurality of heat sources being positioned on the downstream side in the conveying direction of the recording material.

3. The heating device according to claim 2, wherein, in a case where the temperature detected by the temperature detecting unit is lower than a predetermined threshold value, the controller turns on the heat source positioned on the upstream side in the conveying direction of the recording material, or the controller increases an output of the heat source positioned on the upstream side in the conveying direction of the recording material, and in a case where the temperature detected by the downstream side detecting unit is lower than another predetermined temperature, the controller turns on the heat source positioned on the downstream side in the conveying direction of the recording material, or the controller increases the output of the heat source positioned on the downstream side in the conveying direction of the recording material.

4. An image forming apparatus comprising:

an image forming unit that forms an image on a recording material;

a heating unit that includes a plurality of heat sources which are disposed so that locations thereof are different from each other in a conveying direction of the recording material, and that heats the recording material on which an image is formed by the image forming unit;

a temperature detecting unit that is positioned on an upstream side in the conveying direction of the recording material with respect to the plurality of heat sources, and that detects a temperature of the heating unit; and a controller that controls one of the plurality of heat sources based on a detecting result obtained by the temperature detecting unit, the one of the plurality of heat sources being positioned on the upstream side in the conveying direction of the recording material, wherein a thickness of a portion of the heating unit which temperature is to be detected by the temperature detecting unit is smaller than a thickness of a portion of the heating unit positioned between the conveyed recording material and the plurality of heat sources.

* * * * *